United States Patent [19]

Dietrich et al.

[11] 4,333,324

[45] Jun. 8, 1982

[54] SPRING/DEAD BOLT LOCK ASSEMBLY

[75] Inventors: Hagen Dietrich, Delta; William J. Fane, North Vancouver, both of Canada

[73] Assignee: Norris Industries, Inc., Huntington Beach, Calif.

[21] Appl. No.: 161,899

[22] Filed: Jun. 23, 1980

Related U.S. Application Data

[63] Continuation-in-part of Ser. No. 35,208, May 2, 1979, Pat. No. 4,255,953.

[51] Int. Cl.[3] ..... E05B 59/00; E05B 55/00

[52] U.S. Cl. ..... 70/107; 70/134; 70/143; 70/472; 292/172; 292/DIG. 27

[58] Field of Search ..... 70/107–111, 70/129, 134, 143, 472; 292/140, 169.15, 169.17, 172, DIG. 27

[56] References Cited

U.S. PATENT DOCUMENTS

| | | | |
|---|---|---|---|
| 2,664,306 | 12/1953 | Cerf, Jr. | 292/169.17 X |
| 3,751,085 | 8/1973 | Sanders et al. | 292/169.15 X |
| 3,790,196 | 2/1974 | Sanders et al. | 292/140 |
| 3,912,309 | 10/1975 | Fischer et al. | 70/143 X |
| 4,052,092 | 10/1977 | Berger | 292/172 |
| 4,255,953 | 3/1981 | Dietrich et al. | 70/107 |

*Primary Examiner*—William E. Lyddane
*Attorney, Agent, or Firm*—Vernon D. Beehler

[57] ABSTRACT

One part of a key-in-knob lock set functions in a normal manner such that when the lock set is unlocked, either the outside or inside knob can be manipulated to open the door by withdrawing the latch bolt from a normal spring latch extended position. When, instead, the lock set is locked, the latch bolt is extended an exceptionally long distance into the frame to a dead bolt position. Extension and retraction of the latch bolt to and from dead bolt position is accomplished by manipulation of a main cam through the agency of a key in the outside or a turn button on the inside.

For withdrawing the latch bolt from the normal spring latch extended position, an escutcheon housing for the outside knob or a corresponding escutcheon housing for the inside knob serves, by moving transversely of the axis of rotation of the knob, to rotate a radially extending tooth-like element on the spindle which, acting through the main cam, withdraws the latch bolt.

By rotation of the key on the outside, or the turn button on the inside, the spindle is rotated a greater amount, far enough to have the main cam extend the latch bolt an additional distance to the dead bolt position. In that dead bolt position the tooth-like element for the hub cam of the outside knob is moved out of the path of movement of the respective drive housing so that rotation of the outside knob has no effect on the latch bolt. The tooth-like element for the hub cam of the inside knob remains, however, in movable engagement with the corresponding drive housing so that rotation of the inside knob does in fact withdraw the latch bolt from the dead bolt position.

10 Claims, 21 Drawing Figures

Fig. 5.
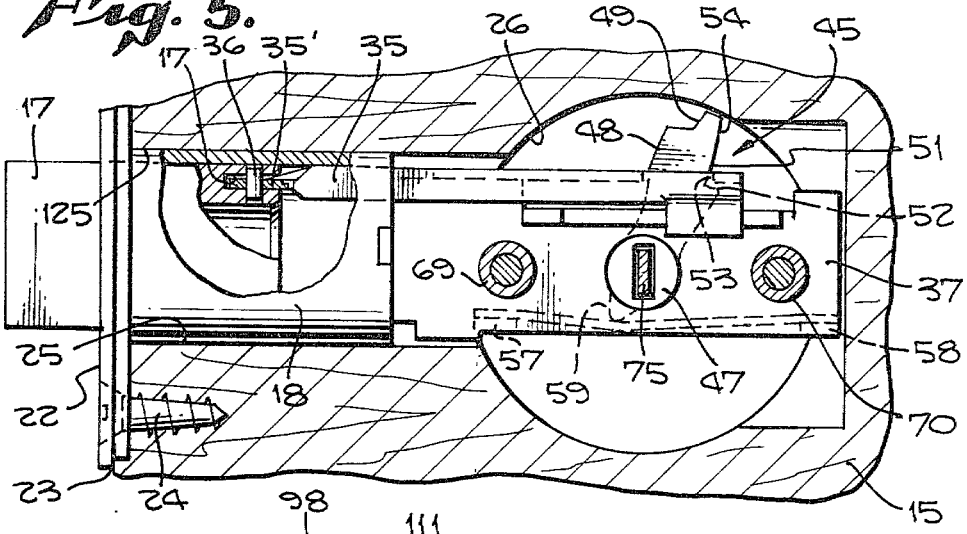
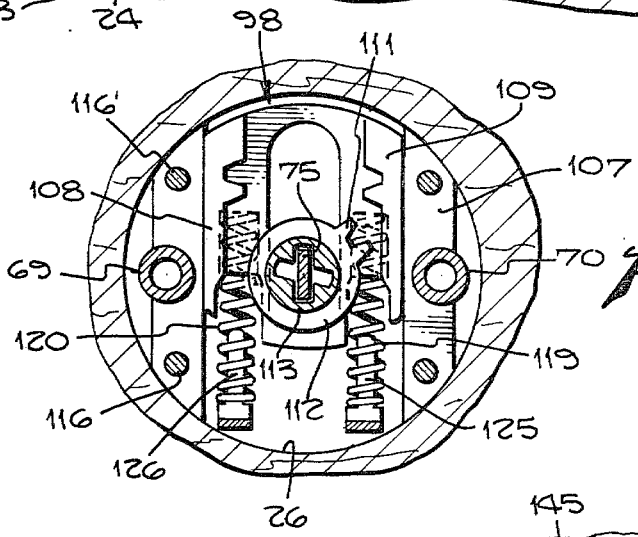
Fig. 6.
Fig. 7.
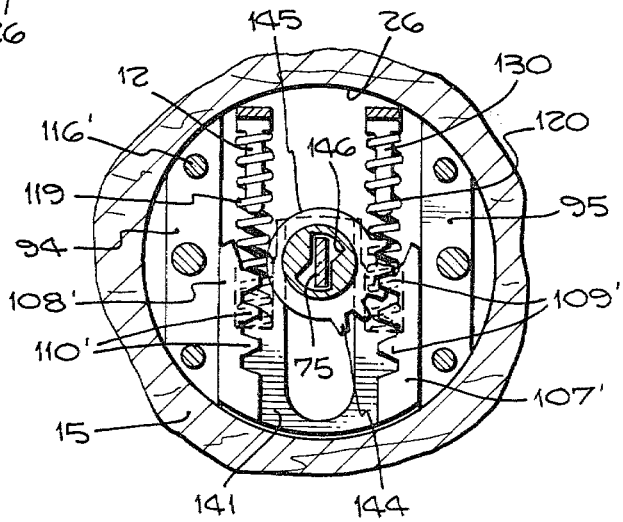

Fig. 8.
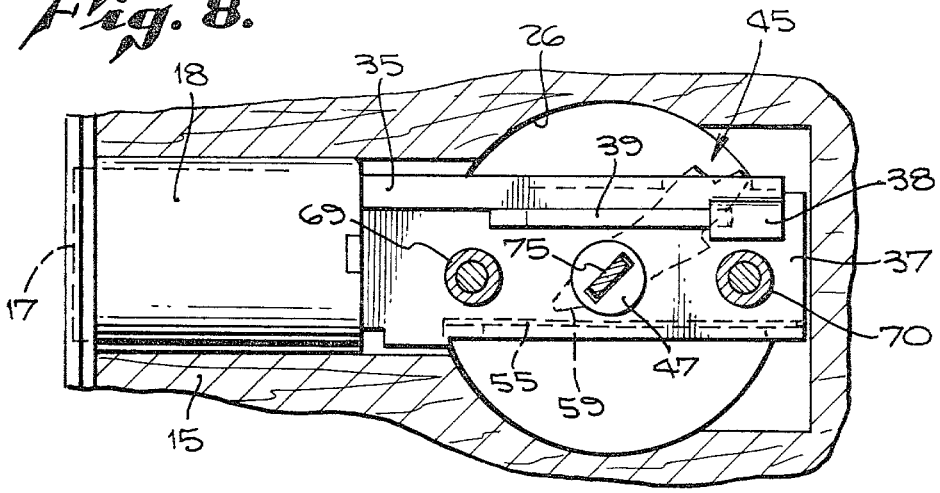
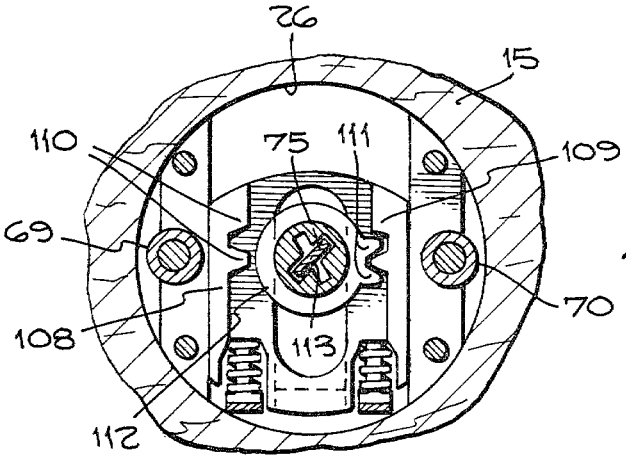
Fig. 9.
Fig. 10.
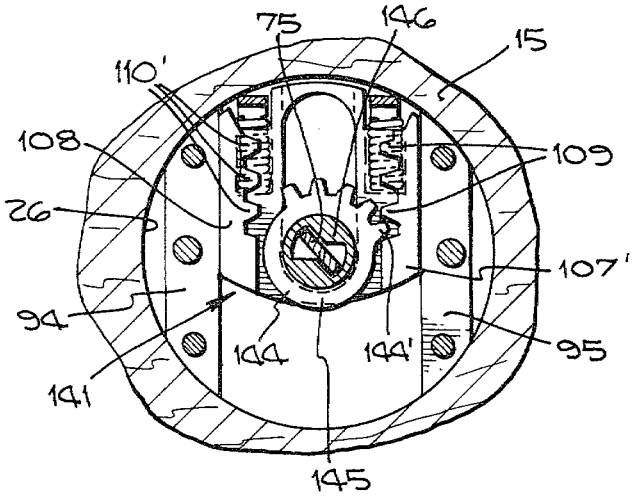

Fig. 11.
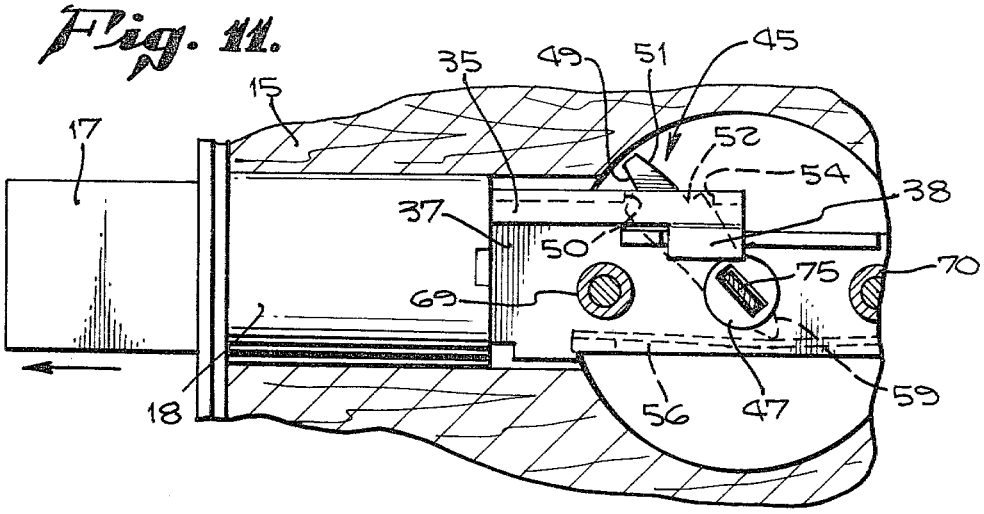
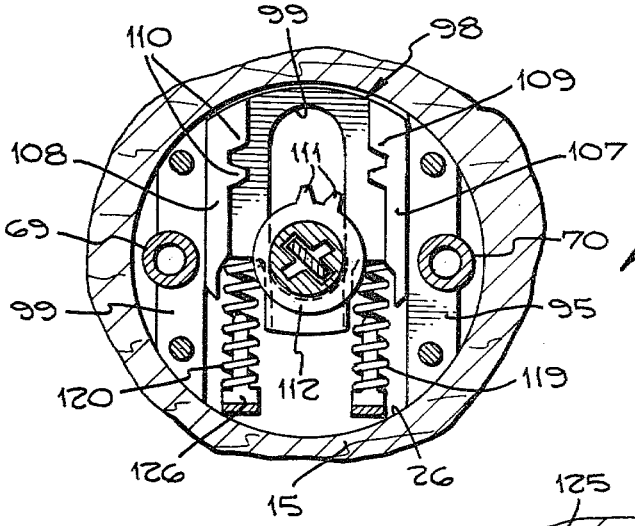
Fig. 12.
Fig. 13.
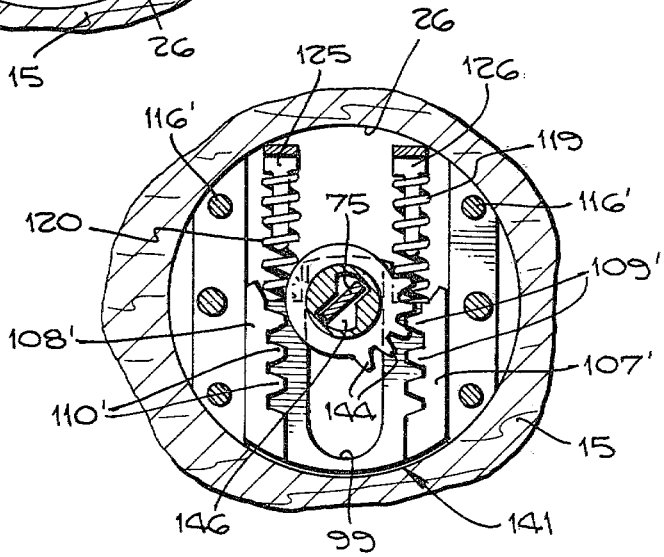

65
66'
66
87'
70
87
69
89
87
75
87
86
84
89'
93
90
94
91
94'
95
92
95'
116
96
97
116'
111
112
113
114
116
115
116
117
125
126
100
98
110
109
102
107
104
99
108
120
119
125
126
117
118
142
144
145
146
144'
143
149
137
139
147
140
148
138
136
89
135
71
72
119
120
102
101
99
141

SPRING/DEAD BOLT LOCK ASSEMBLY

This is a continuation-in-part of copending application Ser. No. 35,208, filed May 2, 1979 now U.S. Pat. No. 4,255,953.

With the progressively increasing incidents of unlawful entry into locked premises, there has at the same time been appreciable increase in employment of dead locks built into what are commonly identified as key-in-knob locks. Such key-in-knob locks offer relatively little security because, whether or not the dead lock feature is included, there is no more than about one-half inch bolt projection. To compound the deficiency when a one-eighth inch minimum gap between the door jamb is maintained, there remains no more than about three-eighths inches of maximum positive engagement of the latch bolt with the strike plate. When an installation of such character is the object of unlawful entry, the door jamb can be spread slightly further away from the door using any one of a number of conventional prys which is sufficient to have the latch bolt clear the strike and permit the door to be swung open. The three-eighths inch or less engagement is so little that on some occasions it may be possible to pry the latch bolt back by merely inserting a credit card into the clearance until it engages the latch bolt.

In appreciation of these limitations, there has been a considerable increase in the use of auxiliary dead bolts. Although such auxiliary dead bolts add appreciably to the security of an installation they are an extra piece of hardware, require an additional installation hole in the door and the door jamb, and frequently require an additional key, where they cannot be keyed to match the key-in-knob lock set. Such installations further complicate the inside panic prospect which needs to be guarded against and which is apt to be more prevalent as the security expedient is increased.

It is therefore among the objects of the invention to provide a new and improved spring-type latch which is modified so that it can also serve as a dead bolt lock.

Another object of the invention is to provide a new and improved spring-type latch of such construction that the same latch bolt serving as a spring-type latch can serve as a dead bolt lock when greater security is desired.

Still another object of the invention is to provide a new and improved spring-type latch bolt which extends no more than the conventional distance into the door jamb while the lock set is serving as a passage set but which by manipulation of either a key on the outside or a thumb turn on the inside can be extended an additional distance into the door jamb to serve as a dead bolt lock with its accompanying added security.

Still another object of the invention is to provide in one lock set a latch bolt serving either as a spring latch or a dead bolt lock, and which, at the same time, is of such construction that although extended to dead lock position by a key on the outside the latch bolt can be readily and immediately withdrawn to unlocked position on the inside by merely turning the knob.

Still further among the objects of the invention is to provide a new and improved door lock of the type wherein the latch bolt serves simultaneously either as a spring latch or a dead bolt lock in an arrangement such that the latch bolt is normally extended to the spring latch position but can be further extended by key action associated with an outside operating member or by comparable activity on the inside which may be either a turn button, if desired, or other means, whereby to extend the latch bolt to dead bolt position, the latch bolt then being capable of being unlocked either by key actuation on the outside or by merely knob-like action on the inside.

Also included among the objects is to provide for outside operating action of the spring lock mechanism by either a lever-acting thumb piece member or a rotating knob member.

With these and other objects in view, the invention consists of the construction, arrangement and combination of the various parts of the device serving as an example only of one or more embodiments of the invention, whereby the objects contemplated are attained, as hereinafter disclosed in the specification and drawings, and pointed out in the appended claims.

FIG. 1 is a transverse fragmentary sectional view of a door and door jamb showing a complete lock set mounted in operating position.

FIG. 5 is a side elevational view of the latch bolt subassembly, with the latch bolt in spring latch position on the line 5—5 of FIG. 1.

FIG. 6 is a cross-sectional view on the line 6—6 of FIG. 2.

FIG. 7 is a cross-sectional view on the line 7—7 of FIG. 2.

FIG. 8 is a side elevational view of the latch bolt assembly similar to FIG. 5 but in a withdrawn position.

FIG. 9 is a cross-sectional view similar to FIG. 6 with parts in position for latch bolt retracted.

FIG. 10 is a cross-sectional view similar to FIG. 7 with parts in position for latch bolt retracted.

FIG. 11 is a side elevational view of the latch bolt subassembly similar to FIG. 5 but with the latch bolt in dead bolt position.

FIG. 12 is a cross-sectional view similar to FIG. 6 with parts in locked position.

FIG. 13 is a cross-sectional view similar to FIG. 7 with parts in locked position.

Figure 4:
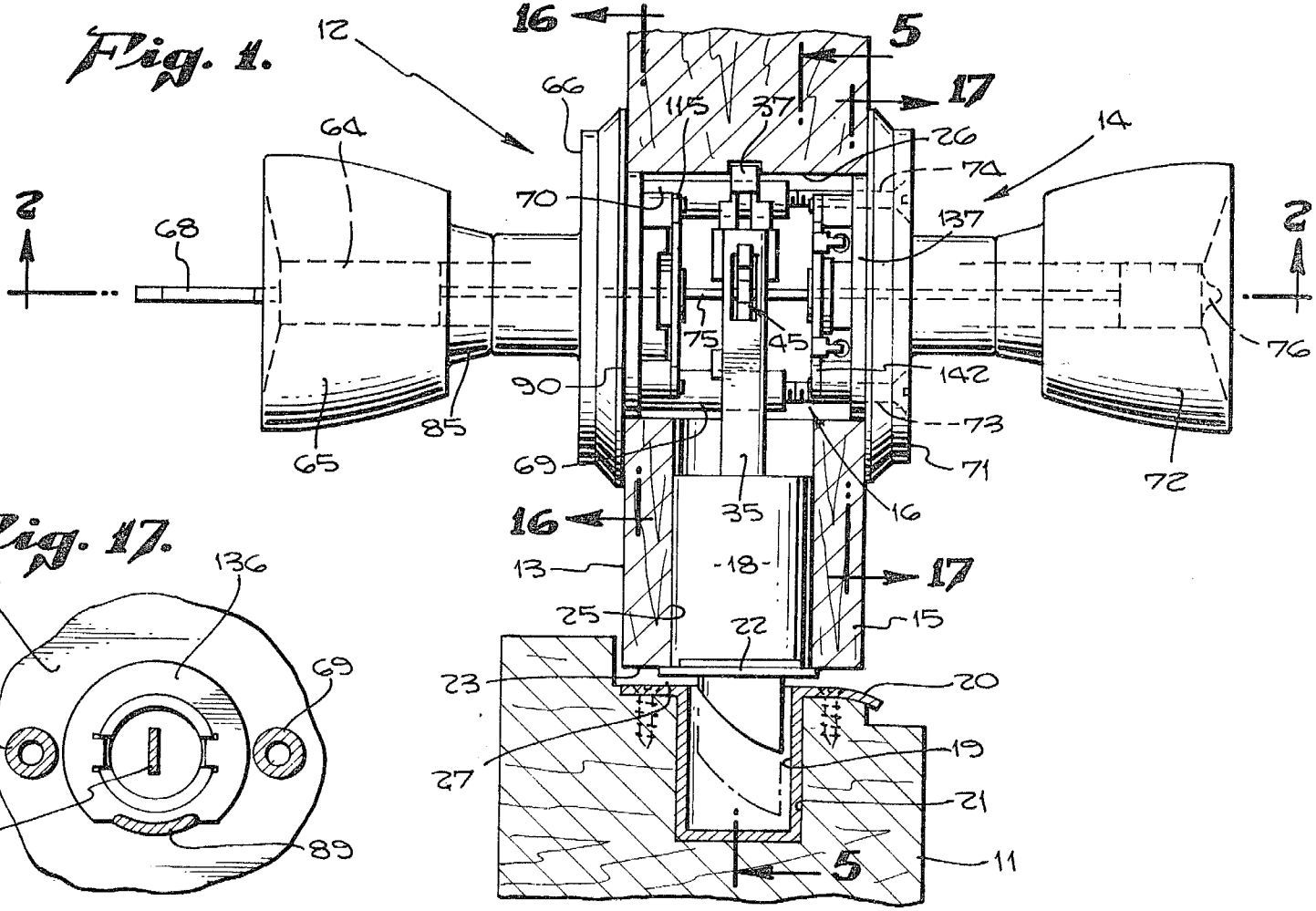
FIG. 4 is a cross-sectional view similar to FIG. 3 in a different position of operation.
Figure 17:
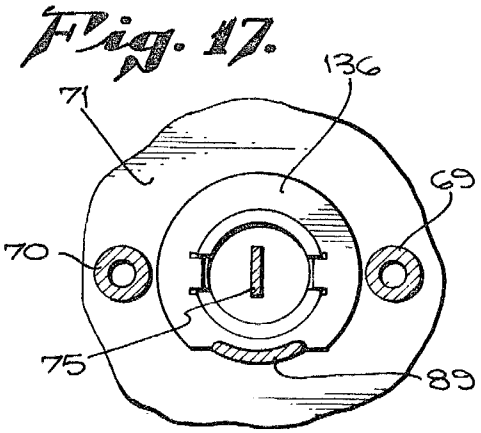
FIG. 17 is a fragmentary cross-sectional view on the line 17—17 of FIG. 1.

An embodiment of the invention modified with respect to the parent application features a lock set of the original type used on outside doors of houses, apartments and comparable structures wherein as an alternative a pull type handle may, if desired, be employed instead of a conventional knob initially shown.

The spring/dead bolt lock combination is shown mounted on a fragment of door 10 which is adapted to swing relative to a door jamb 11. The device consists in the main of an outer trim 12 applied to an outside surface 13 of the door 10, an inner trim 14 applied to the inside surface 15 of the door and a latch bolt subassembly 16. The latch bolt subassembly includes a latch bolt 17 reciprocatably mounted in a face and case assembly 18 so that it can project through a hole 19 in a strike plate 20, the strike plate 20 being attached to the door jamb 11 over a latch bolt recess 21. A face plate 22 is attached to an edge face 23 of the door 10 by means of appropriate screws 24. An edge hole 25 extending inwardly from the edge face 23 accommodates the face and case assembly 18 together with the latch bolt subassembly 16 operating with it. A transverse hole 26 intersects the edge hole and accommodates the sundry operating parts of the spring/dead bolt combination lock.

As shown in the drawings, the door 10 has been mounted for swinging between open and closed position relative to the door jamb 11 in an arrangement such that there is a gap or clearance 27 of a conventional distance through which the latch bolt 17 must extend before entering the strike plate 20.

The latch bolt subassembly 16 in a broad sense is of generally conventional construction and operation such as has been disclosed in U.S. Pat. Nos. 3,751,085 and 3,790,196, but with significant variations. More particularly there is provided in the latch bolt subassembly a bolt extension 35 attached to the latch bolt 17 by means of a roll pin 36, see FIGS. 5 and 14. The bolt extension 35 is slidably accommodated in a case extension 37 wherein shoes 38 on opposite sides of the bolt extension are guided by tracks 39 on the case extension. A compression spring 42 acting between the bolt extension 35 and a shoulder 43 of the case extension, serving as a springkeeper, serves normally to urge the latch bolt and bolt extension outwardly to extended position. There is a transverse slot 17' in the latch bolt 17 which receives a tongue 35' on the bolt extension 35. Pinned in this fashion by the roll pin 36 there is a limited freedom of motion allowed the latch bolt 17, and the flexible pinned connection absorbs the blow in case the door is slammed with the bolt extended, which could otherwise distort and bind the bolt action.

Assembled in the latch bolt subassembly is a main cam member 45 consisting of a latch cam 46 extending radially outwardly from a hub 47 about which the latch cam is adapted to rotate. On a forward face 48 of the latch cam is a detent notch 49 which in one position of the latch cam (FIG. 11) is adapted to engage a cam engaging shoulder 50 extending transversely of the latch bolt extension 35. On a rearward face 51 of the latch cam is another detent notch 52 adapted to engage another transversely extending cam engaging shoulder 53 of the bolt extension 35. An opening 54 intermediate the cam engaging shoulders 50 and 53 accommodates the latch cam.

Flat springs 55 and 56 which span the distance, FIGS. 5 and 8, between appropriate springkeepers 57 and 58 on the case extension 37 are positioned to engage a projection 59 from the hub 47 so as to releasably hold the latch cam in overcenter position when the latch bolt subassembly is extended or withdrawn.

Forming part of what has previously been referred to as the outer trim 12 is an outside knob 65 rotatably mounted on an outside trim plate or rose 66. The knob houses a substantially conventional key actuated mechanism 64, adapted to be manipulated by a key 68. Posts 69 and 70 attached to the inside face of the rose 66 extend through the transverse hole 26 to positions adjacent an inside rose 71 for an inside knob 72 where the posts are engaged by trim attaching screws 73 and 74. The key actuated mechanism in the outside knob 65 is operably attached to a spindle or tailpiece 75, the spindle or tailpiece being of a length such that it extends through the door to a position of engagement with a turn button or thumb turn 76, rotatably mounted in the inside knob 72.

Figure 14:
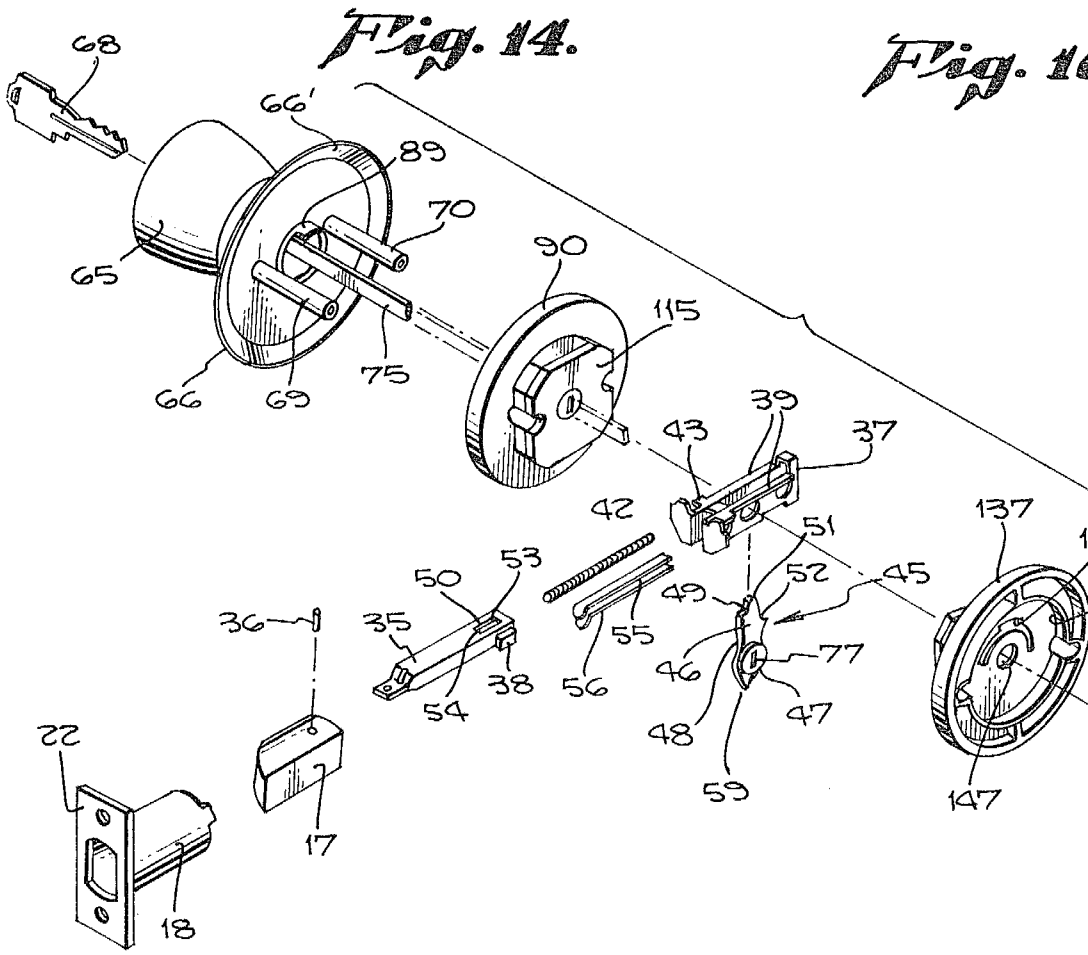
FIG. 14 is an exploded perspective view with the latch bolt subassembly disassembled.

As shown to good advantage in the exploded FIG. 14 of the drawing the spindle 75 projects through a slot 77 the main cam member 45. As a result of this arrangement the main cam member is rotated either by action of the key 68 or by action of the turn button or thumb turn 76. Rotation in one direction projects the latch bolt 17 to dead bolt position. Rotation in the opposite direction withdraws the latch bolt to a completely withdrawn position.

Figures 2, 3, 4:
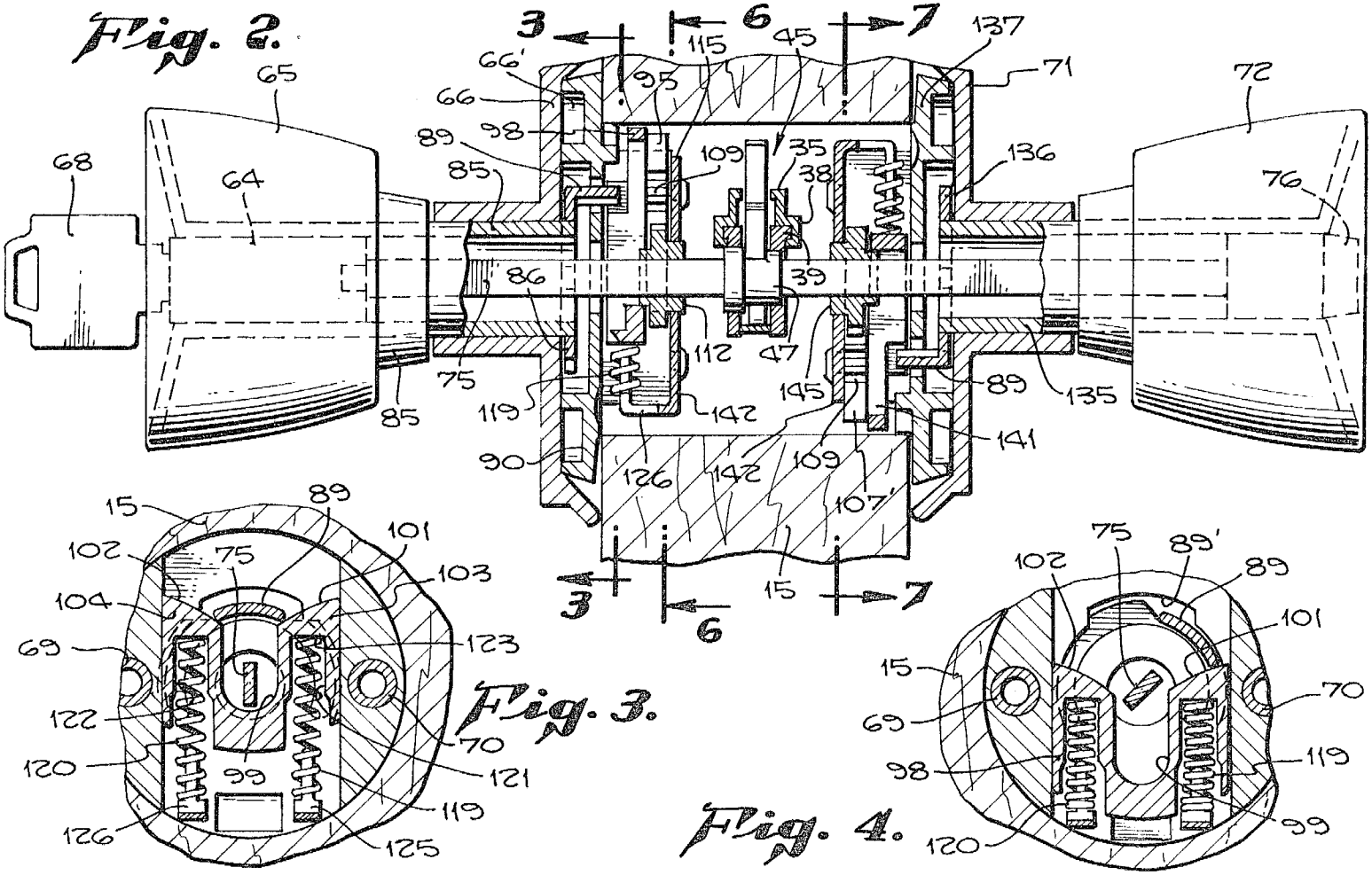
FIG. 2 is a longitudinal sectional view on the line 2—2 of FIG. 1.
FIG. 3 is a cross-sectional view on the line 3—3 of FIG. 2.
Figure 16:
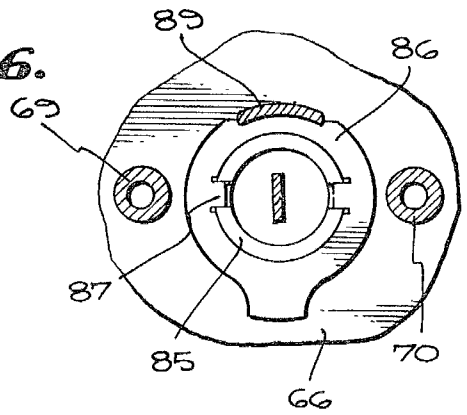
FIG. 16 is a fragmentary cross-sectional view on the line 16—16 of FIG. 1.

For mounting the outside knob 65 in the outside rose 66, the outside knob is provided with a shank 85 extending through the rose 66 to which it is secured by action of a combination cam and retaining washer 86, the cam and retaining washer being staked to the shank 85. Projections 87 engage slots 87'. A raised arcuate cam 89 serves to activate an outside drive housing 98, FIGS. 15 and 2.

An outside escutcheon housing 90 is provided with holes 91 and 92 for accommodation of the posts 69 and 70, the escutcheon housing 90 being such that it is capable of being drawn up snugly against the inside face of the outside rose 66. An opening 93 accommodates the spindle 75, FIG. 15. There is also an arcuate opening 89' in a partition 84 which accommodates the arcuate cam 89 and allows it to rotate. The outside escutcheon housing 90 is small enough in outside dimension to be concealed by the outer rose 66 and be at least partially received within a recess 66' on the inside face of the rose.

On the inner side of the outside escutcheon housing 90 are blocks 94 and 95 provided with inwardly directed faces 96 and 97 spaced apart so as to provide a slot or guideway between them. Slidably mounted in the guideway is the outside drive housing 98 in the guise of a slide which is capable of sliding in a transverse direction within the guideway. A transversely extending aperture 99 in the outside drive housing 98 accommodates the spindle 75 and allows drive housing to slide transversely with respect to the spindle. The blocks 94 and 95 have respective outwardly facing flats 94', 95', either of which is capable of accommodating the latch bolt 16 as would be desirable under unfavorable conditions such as a short backset or thin door application.

On an outer face 100 of the outside drive housing 98 are ledges 101 and 102 serving as cam ways for engagement by one end edge or the other of the arcuate cam 89 of the cam and retaining washer 86. It is the action of the end edges of the arcuate cam on the ledges which give the outside drive housing 98 motion in a transverse direction, namely, diametrically with respect to the axis of the spindle 75. Bosses 103 and 104 provide adequate thickness in order for the ledges to be formed, FIGS. 2, 3 and 4.

On the inner face 106 of the outside drive housing 98 is another pair of bosses 107 and 108 which provide rack teeth 109 and 110. These last mentioned rack teeth are designed to cooperate with gear teeth 111, two in number, which extend radially outwardly from a hub 112. In the hub is a slot 113 for reception of the spindle 75 so that shifting the gear teeth 111 causes the hub to rotate the spindle 75, thus providing an outside driving means.

Actually there is a second slot 114 angularly disposed with respect to the slot 113, likewise adapted to receive the spindle. The second slot 114 is made use of when the device is readjusted for installation on a door which opens in the opposite direction. In a sense the hub serves as a hub cam, the hub cam and teeth serving as a driving means for the spindle, and as a consequence a driving means for the latch bolt subassembly. By providing a rack and teeth comparable to a degree to gear teeth, a positive smooth-acting drive is assured when the teeth engage.

Figure 15:
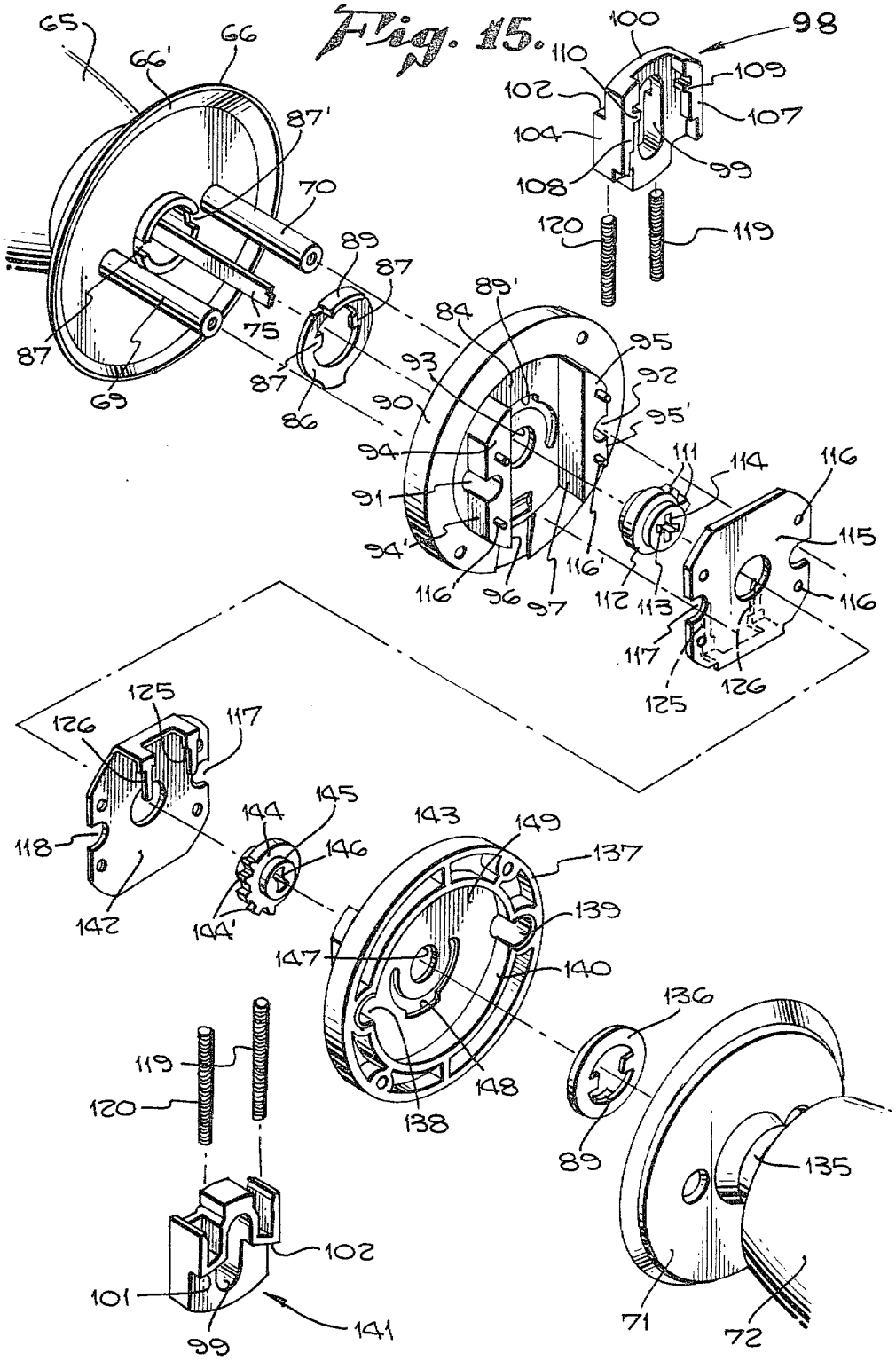
FIG. 15 is an exploded perspective view to slightly larger scale with the escutcheon housings disassembled.
Figure 19:
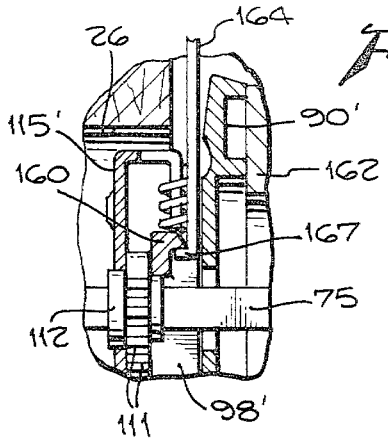
FIG. 19 is a fragmentary sectional view on the circle line 19 of FIG. 18.
Figure 18:
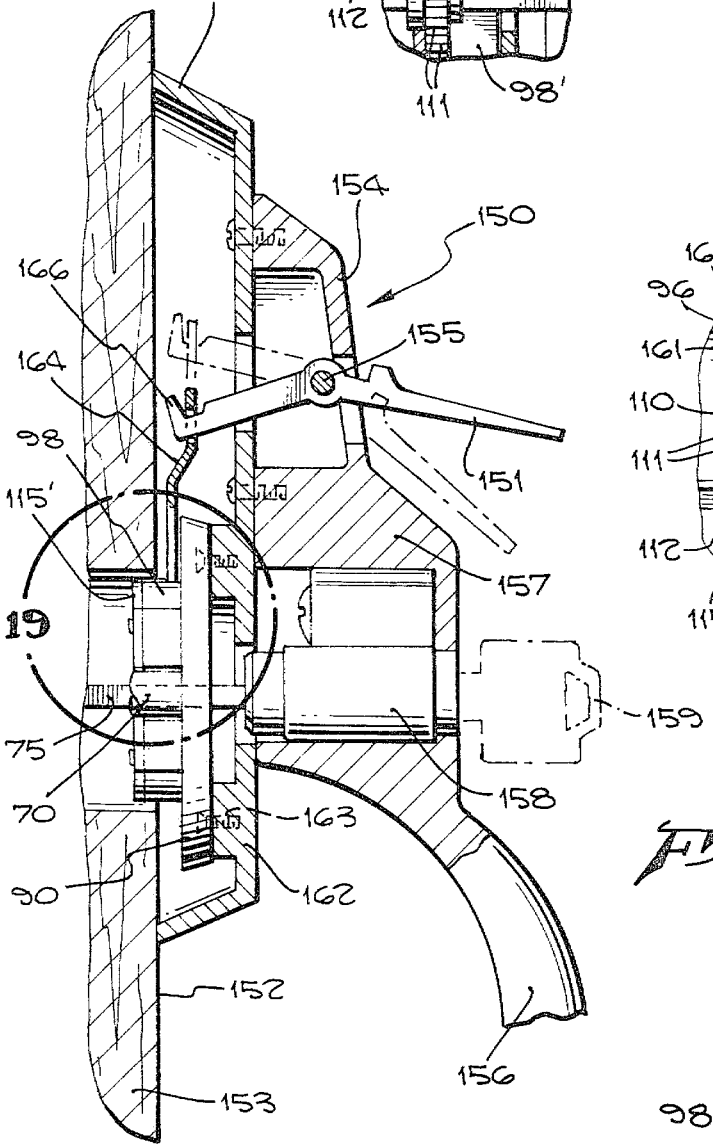
FIG. 18 is a vertical sectional view of a modified form of an outside handhold assembly.
Figure 20:
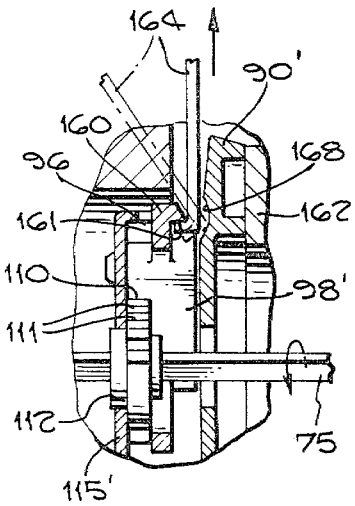
FIG. 20 is a fragmentary sectional view similar to FIG. 19 but showing parts while being assembled.
Figure 21:
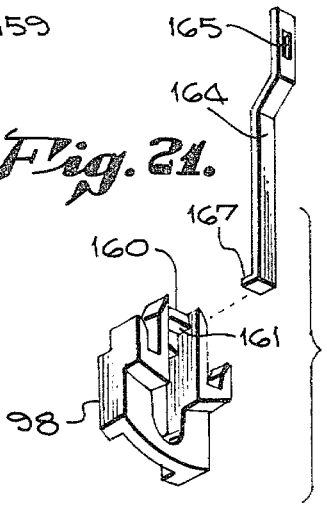
FIG. 21 is an exploded perspective view of the lift link and outside drive housing of FIGS. 18–20.

For confining the outside drive housing 98 in its reciprocating position an escutcheon cover 115 is applied to the surfaces of the blocks 94 and 95 and positioned therein by appropriate holes 116 and matching pegs 116', riveted over or staking the cover in place. Recesses 117 and 118 in the cover coincide with the respective holes 91 and 92 in the escutcheon housing 90 for accommodation of the posts 69 and 70 (FIG. 15).

For normally urging the outside drive housing 98 toward one end of its transverse direction of travel, for example, upwardly as shown, there are provided springs 119 and 120 received in respective openings 121 and 122 of less depth than the length of the springs, the bottoms 123 and 124 of which serve as springkeepers. Opposite ends of the springs are retained by springkeepers 125 and 126 which extend from the adjacent face of the escutcheon cover 115.

The inner trim 14 and associated parts are to a large degree the same as the outer trim 12 and its associated parts, an important difference being that the key actuated mechanism 64 of the outer trim is replaced by the turn button 76 in the inner trim.

In a similar fashion an appropriate shank 135 enables the inside knob 72 to be attached rotatably on the inside rose 71 by employment of a cam and retaining washer 136 in the same manner as has been described for the outside knob and outside rose. There is also a similar inside escutcheon housing 137 with appropriate holes 138 and 139 for the posts 69 and 70 and recess 140 for accommodation of the inside cam and retaining washer 136. A central opening 147 accommodates the spindle 73 and an arcuate opening 148 in a partition 149 accommodates the arcuate cam 89 of the cam and retaining washer 136.

An inside drive housing 141 has in general the structure and function of the outside drive housing 98, with some differences. In the drawing it is shown, for example, reversed side for side and end for end in its position with respect to the other operating parts. An inside escutcheon cover 142 acts in the same fashion as the outside escutcheon cover 115, to hold the inside drive housing 141 in its reciprocating position within an appropriate guideway 143.

An inside arcuate gear section 144 having a multiple number of gear teeth 144' on a hub 145 is somewhat different in its structure and action from the outside gear teeth 111 on the hub 112. The inside hub 145 has a single slot 146 for reception of the spindle 75. The slot 146 is enlarged rotationally to allow a degree of rotation of the spindle relative to the hub 45, namely, lost motion.

For operation with the inside arcuate gear section 144 and its teeth 144', the inside drive housing 141, slightly different from the outside drive housing 89, has bosses 107' and 108' which provide, respectively, rack teeth 109' and 110' numbering three full teeth in each instance, FIGS. 7, 10, 13. Also since one or more of the rack teeth 109', for example, are always in engagement with one or more of the gear teeth 144', rotation of the inside knob will always be capable of withdrawing the latch bolt.

In operation let it be assumed that when the device is serving as a spring latch, the key operated mechanism 64 is in unlocked position, as is also the turn button 76. When this condition prevails, the compression spring 42 is acting to extend the bolt extension 35 and attached latch bolt 17 outwardly to the position of FIGS. 1 and 5. As thus extended, the latch bolt will span the gap 27 and project into the hole 19 in the strike plate 20. The distance extended is normally about one-half inch.

When thus extended, the latch bolt can be withdrawn by rotating either the outside knob 65 or the inside knob 72. If it be the outside knob which is rotated, FIGS. 1, 2, 3 and 4, that rotation in turn will rotate the cam and retaining washer 86, in one direction or the other as the case may be. Depending on which is the direction of rotation, one end or the other of the arcuate cam 89 will move downwardly into engagement with the corresponding ledge 101 or 102 serving as a cam way. This will cause the outside drive housing 98 to move transversely which, in FIGS. 6 and 9 is downwardly as shown, forcing the rack teeth 109 into engagement with the gear teeth 111, thereby to rotate the hub 112 in a clockwise direction, see FIGS. 6 and 9. Movement as described will cause the spindle 75 to likewise rotate in a clockwise direction. When the spindle 75 rotates as described, the main cam member 45 and its latch cam 46 will move its rearward face 51 against the cam engaging shoulder 54 of the bolt extension 35, causing it to move in a direction from left to right as viewed in FIGS. 5 and 8. As a consequence the latch bolt 17 will be withdrawn.

Should it be the inside knob which is rotated under these circumstances, it will be the cam and retaining washer 136 which is rotated so that one end or the other of the corresponding arcuate cam 89 will be moved against a corresponding ledge 101, 102 of the inside drive housing 141, serving as a cam way. In this instance the drive housing 141 is moved transversely which, in the embodiment shown, is upwardly, the upward movement causing the rack teeth 109', 110' to move upwardly from the position of FIG. 7 to the position of FIG. 10. In this particular example the rack teeth 109' move in engagement with the gear teeth 144' causing the hub 145 to rotate in a counterclockwise direction, as viewed in FIG. 10. The counterclockwise motion causes the spindle 75 to rotate in a counterclockwise direction, the result of which is to rotate the main cam member 45 in the same manner as previously described, thereby to withdraw the latch bolt 17. Since FIGS. 6 and 10 are viewed in opposite directions the net effect on the spindle 75 is the same.

Let it now be assumed that the latch bolt is to be extended to dead bolt position, namely, in the position of FIG. 11. This can be accomplished either by action of the key 68 or the turn button 76. If the key 68 is rotated, the key actuated mechanism 64 serves to rotate the spindle 75 in a counterclockwise direction, as viewed in FIGS. 11 and 12. This has the effect of rotating the main cam member 45 in counterclockwise direction moving the forward face 48 against the cam engaging shoulder 50 of the bolt extension 35. The end result is shifting the latch bolt outwardly to full extended dead bolt position as shown in FIG. 11. In that position the detent notch 49 engages the cam engaging shoulder 50 so that the latch bolt is in effect locked in the outwardly extended position.

The same result is accomplished when the turn button is rotated. Such rotation also results in the counterclockwise rotation of the spindle with the same sequence of events causing extension of the latch bolt to dead bolt position. In that position the latch bolt can be withdrawn by rotation of the inside knob 72 but cannot be withdrawn by rotation of the outside knob 65. The reason for being able to withdraw the latch bolt by action of the inside knob 72 is because, whether the latch bolt is in the spring latch position of FIG. 5, partially extended, or the dead bolt position of FIG. 11, fully extended, the angular disposition of the gear teeth 144' for the inside hub 145 is such that the teeth 144' are in engaging position with the rack teeth 109'. Consequently rotation of the inside knob and its cam and retaining washer 136, when acting to move the inside drive housing 141 in a transverse direction, serves to rotate the spindle 75 and cam member 45, in any event, and thereby withdraw the latch bolt until it clears the strike plate.

On the contrary, when the latch bolt is fully extended to dead bolt position, rotation of the outside knob will not have the effect described. This is because, as viewed in FIG. 12, the gear teeth 111 of the outside driving means or hub 112 has an angular disposition such that they lie within the clear way intermediate the bosses 107 and 108. In that position the gear teeth 111 cannot be engaged by either of the rack teeth 109 or 110. Consequently even though the outside knob 65 can be rotated, causing the outside drive housing 98 to move transversely in the usual path and for the usual distance, it has no effect on the spindle and consequently no effect upon the latch bolt.

The latch bolt can, however, be withdrawn from dead bolt position by manipulation of the key 68. The key, acting through the key actuated mechanism 64 in the outside knob 65 rotates the spindle 75 directly and as a consequence the main cam member 45 is rotated so as to shift the bolt extension inwardly the necessary distance, thereby withdrawing the latch bolt against tension of the compression spring 42. Once the key is released together with the outside handle 65, the compression spring 42 will return the latch bolt to its partially extended spring latch position.

It is of consequence that the slot 146 in the hub 145 allows some travel of the latch bolt 17 without movement of the drive housing 141. As shown in FIG. 7, the parts are at rest with one side of the slot 146 in engagement with the spindle 75. When the drive housing 141 is activated by knob action, the hub 145 is rotated counterclockwise and the other side of the slot 146 picks up and engages the spindle 75, moving it to the position of rotation of FIG. 10. Initial movement of the drive housing did not cause the spindle to turn because of the free play of the larger opening 146. Then when extension of the latch bolt to dead locked position is desired, as by key action on the outside or thumb turn action on the inside, the spindle has enough room to travel, clockwise as in FIG. 13, without movement of the drive housing 141.

It is significant that when the latch bolt is released after having been withdrawn and is urged outwardly by the compression spring 42, the detent notch 52 will catch on the edge of the cam engaging shoulder 53 and hold the latch bolt assembly in that position, namely, the partially extended spring latch position, approximately a one-half inch projection. From this position, retraction of the latch bolt in any manner, as by slamming the door or pushing it with the finger, is followed by subsequent urging of the latch bolt outwardly by the spring 42. This results in the latch bolt stopping at the same position, namely, only as far as the spring latch position.

An interesting incident to the structure and operation just described is that rotational movement of either of the knobs in either direction of rotation is translated into transverse movement of one or another of the drive housings. The transverse movement ultimately causes rotation in one direction only of the spindle 75, the main cam 45 and, as a consequence, linear movement of the latch bolt 17.

In a modified form of the invention shown in FIGS. 18 through 21, inclusive, the front door knob has been replaced with a thumb piece 151 of what is commonly referred to as a grip handle set 150. Extending over the exterior face 152 of a door 153 is an exterior escutcheon 154 on which the thumb piece 151 is pivotally mounted by use of a pivot pin 155.

There is a handle 156 extending downwardly from a body section 157, the body section having mounted therein a conventional key actuated mechanism 158 operated by a key 159. Extending into the door from the key operated mechanism is a spindle 75'.

The outside drive housing 98' for the grip handle set 150 is the same, in all material respects, as the outside drive housing 98 heretofore disclosed, a significant added feature being a shoulder 160 providing an undercut 161. The outside drive housing is reciprocatably mounted for sliding vertical motion within an outside escutcheon housing 90' to which has been applied a typical escutcheon cover 115'. The escutcheon housing overlies an exterior mounting plate 162 to which it is mounted at the rear by screws 163.

An elongated connector link 164 has an opening 165 at the upper end allowing it to be engaged by a hook 166 of the thumb piece 151. At the lower end of the link 164 is a projection 167 which underlies the undercut 161 of the shoulder 160.

It follows, therefore, that when the latch bolt 17 is in spring latch position, it can be withdrawn from the outside of the door 15 by depressing the thumbpiece 151. As the hook 166 is then lifted, lifting the connector link 164, the outside drive housing 98' is also lifted. The result is engagement of gear teeth 111 by the rack teeth 109, as previously described, causing rotation of the hub 112 and consequently the spindle 75'.

As an assembly convenience there is a depression 168 in the outside escutcheon housing 90'. By lifting the outside drive housing to the position of FIG. 20, with the connector link in the broken line position, the lower end can be inserted into the depression, the projection engaged beneath the undercut, and the link then moved to the solid line position. Thereafter release of the outside drive housing 98' allows it to lower pulling the connector link down, after which the projection 167 remains trapped in engagement with the undercut 161.

Whenever the latch bolt 17 is extended to dead locked position, the thumb piece 151 becomes inoperative because the teeth 111 and 109 are clear of each other for reasons heretofore explained. The key operative mechanism 158 is, however, operative in the usual manner to withdraw the latch bolt as is also the inside thumb turn.

While particular embodiments of the present invention have been shown and described, it will be obvious to those skilled in the art that changes and modifications may be made without departing from the invention in its broader aspects, and therefore, the aims of its appended claims is to cover all such changes and modifications as fall within the true spirit and scope of this invention.

Having described the invention, what is claimed as new in support of Letters Patent is as follows:

1. A door lock acting as a combination spring latch and dead bolt comprising a latch bolt subassembly with a cam engaging means thereon and adapted to move between a partially extended spring latch position, a dead bolt position, and a withdrawn position, said subassembly comprising a latch bolt, a bolt extension and a case extension in longitudinal alignment, latch bolt actuating means comprising a spindle means and a main cam member on said spindle means having an operating engagement with said cam engaging means, a key actuated outside operating assembly including a spring latch release member in operating relationship with said spindle means, an inside operating assembly including a spring latch release member and a turn member in operating relationship with said spindle means, outside driving means adapted to engage said spindle means for driving said spindle means in a rotating direction, an outside drive housing having an outside drive element thereon in a transversely reciprocating path of movement and adapted to engage said outside driving means, and a rotatable drive member between said outside spring latch release member and said outside drive housing, an inside driving means adapted to engage said spindle means for driving said spindle means in a rotating direction, an inside drive housing having a transversely reciprocating path of movement and having an inside drive element thereon in continuous progressive engagement with said inside drive means, and a rotatable cam drive member between said inside spring latch release member and said inside drive housing, a clear way between said outside drive housing and said outside drive means when said latch bolt subassembly is in dead bolt position whereby the outside spring latch release member is free of operating engagement with said spindle means when the latch bolt subassembly is in dead bolt position.

2. A door lock acting as a combination spring latch and dead bolt as in claim 1 wherein said drive element which is in continuous progressive engagement comprises a set of rack teeth on said inside drive housing and a complementary set of gear teeth on said inside drive means.

3. A door lock acting as a combination spring latch and dead bolt as in claim 1 wherein said outside drive element comprises a set of gear teeth on said outside driving means and said outside drive element comprises a set of complementary rack teeth thereon.

4. A door lock acting as a combination spring latch and dead bolt as in claim 1 wherein there is a lost motion interconnection between said spindle and the outside operating assembly whereby to enable extension of said latch bolt subassembly to dead bolt position without movement of said outside drive housing.

5. A door lock acting as a combination spring latch and dead bolt as in claim 1 wherein there is an escutcheon housing between at least one of said operating assemblies and the interior of the door, said escutcheon housing including a guideway extending transversely for slidable reception of the corresponding drive housing, and an exterior trim plate having an inwardly facing recess larger in transverse dimension than the corresponding transverse dimension of said escutcheon housing whereby to receive said escutcheon housing when in operative assembly on a door.

6. A door lock acting as a combination spring latch and dead bolt as in claim 1 wherein there is an escutcheon housing between at least one of said operating assemblies and the interior of the door, laterally spaced inwardly directed faces on said escutcheon housing forming a guideway for the corresponding drive housing, a partition on said escutcheon housing extending over said guideway, and an arcuately extending opening in said partition providing for an operating relationship between the adjacent operating assembly and the corresponding drive housing.

7. A door lock acting as a combination spring latch and dead bolt as in claim 1 wherein there is an escutcheon housing between one of said operating assemblies and the interior of the door, an exterior trim plate between said one of said operating assemblies and said escutcheon housing, an outer section of said escutcheon housing being engageable with said trim plate, an inner section of said escutcheon housing having a raised portion forming laterally spaced bosses with respective inwardly directed faces forming a guideway for the corresponding drive housing, said raised portion on the side facing said latch bolt having a substantially flat face at a location radially inward of the perimeter of said outer section, said flat face being at a location inwardly of said latch bolt in withdrawn position of said latch bolt subassembly.

8. A door lock acting as a combination spring latch and dead bolt as in claim 1 wherein there is a slot in said latch bolt extending in a horizontal plane with the door lock mounted on the door, a tongue on the end of the bolt extension adjacent said latch bolt, said tongue being located in said slot in subassembled position and a pivot pin extending through said latch bolt and said flange for pivotally securing said latch bolt to said bolt extension.

9. A door lock acting as a combination spring latch and dead bolt as in claim 1 wherein said outside operating assembly comprises a grip handle set including a handhold, a key actuated mechanism in operating engagement with said spindle and a manually operable lever having a manually accessible outside end and an inside end, there being a connecting link between said inside end and the outside drive housing adapted upon operation of said lever to move said outside drive housing through a latch bolt withdrawing stroke.

10. A door lock acting as a combination spring latch and dead bolt as in claim 9 wherein there is an outwardly extending shoulder on said outside drive housing, a projection on said link in shifting engagement with said shoulder and an articulated connection between said link and said lever.

* * * * *